United States Patent [19]

Carey

[11] Patent Number: 5,031,348

[45] Date of Patent: Jul. 16, 1991

[54] GUN STOCK ASSEMBLY WITH COORDINATED COMB AND RECOIL

[76] Inventor: Donald C. Carey, 9900 SE. Telford Rd., Boring, Oreg.

[21] Appl. No.: 591,669

[22] Filed: Oct. 1, 1990

[51] Int. Cl.[5] ..... F41C 23/06; F41C 23/14

[52] U.S. Cl. ..... 42/74; 42/73; 42/71.01

[58] Field of Search ..... 42/1.06, 71.01, 73, 42/74

[56] References Cited

U.S. PATENT DOCUMENTS

| | | | |
|---|---|---|---|
| 837,601 | 12/1906 | Behr | 42/74 |
| 3,233,354 | 2/1966 | Ahearn | 42/74 |
| 4,663,877 | 5/1987 | Bragg | 42/74 |
| 4,769,937 | 9/1988 | Gregory et al. | 42/74 |
| 4,896,446 | 1/1990 | Gregory | 42/73 |
| 4,910,904 | 3/1990 | Rose | 42/74 |

OTHER PUBLICATIONS

Existing Factory Design, "Carey Comb", Don Carey, Allison & Carey Gun Works, Portland, Oregon.

*Primary Examiner*—Michael J. Carone
*Attorney, Agent, or Firm*—Eugene D. Farley

[57] ABSTRACT

A shoulder gun stock assembly has a comb piece coordinated with a shoulder piece and an associated recoil assembly. The comb piece and shoulder piece remain stationary during shooting while the recoil assembly absorbs the recoil. The comb piece provides a stationary cheek rest which eliminates the cheek-chafing action usually associated with the operation of shoulder firearms.

9 Claims, 3 Drawing Sheets

58
56
52
48
56
58
50
82
80
16
50
66
64
60
68
98
32
98
74
72
70
28
38
34
36
90
92
96
96
90
30
88
86
20
22
12
24
94
76
78
84
42
26
46
18
44
40
10
14
46

GUN STOCK ASSEMBLY WITH COORDINATED COMB AND RECOIL

The present invention relates to shoulder guns, i.e. shotguns and rifles, equipped with recoil-absorbing apparatus. It pertains particularly to recoil-absorbing shotguns, since the telescopic sights usually associated with rifles can cause injury to the eye if employed in conjunction with gun stock assemblies of the presently described class.

BACKGROUND AND GENERAL STATEMENT OF THE INVENTION

As is well known to all hunters and trap shooters, the continued shooting of shotguns and rifles leads to chafing and bruising of the cheek. This is particularly true in trap shooting with shotguns, where several hundred rounds may be fired by a single marksman in a single day.

As a result, the marksman tends to flinch with each shot, with resultant inaccuracy of marksmanship.

This undesired result obtains even with firearms equipped with conventional recoil devices. In the use of such devices, the shoulder piece remains stationary, but the gun stock moves with each shot, causing the unfortunate result outlined above.

It has been proposed, for example in U.S. Pat. No. 4,663,877, to associate the substantially stationary shoulder piece of a firearm designed to minimize recoil with a stationary comb piece on the shotgun stock, against which comb piece the marksman rests his cheek. Since the comb piece remains stationary with the shoulder piece, chafing is eliminated.

It is the general purpose of the present invention to provide such an assembly of improved efficiency and simplified construction.

It is a particular purpose of the present invention to provide such an assembly which may be applied efficiently and at minimum cost to recoil-absorbing commercial firearms not so equipped, for example to the Browning shotguns.

The shoulder gun stock assembly of my invention which achieves the foregoing and other objects of the invention comprises, briefly stated, a base portion, a comb piece, and a shoulder piece.

The comb piece may be provided by cutting away the upper portion of the gun stock to provide a truncated base having a contoured upper surface in which the comb piece nests in longitudinally slidable relation.

The upper surface of the base portion is hollowed out to form forward and rearward recesses.

The central area of the base portion is provided with a longitudinal bore generally parallel to and below the recesses.

Recoil damping plunger means is mounted inside the bore and connected to the shoulder piece.

A first slide block is mounted in the rearward recess and connected to the plunger means.

First comb piece support means mount the comb piece to the first slide block.

A second slide block is mounted in the forward portion of the recess.

Second comb piece support means mounts the comb piece to the second slide block.

During shooting, the shoulder piece remains stationary relative to the rearwardly moving gun stock. This drives the plunger means and absorbs the recoil At the same time the comb piece mounted on the two support blocks remains stationary. Bruising and abrasion of the cheek of the marksman thus is avoided.

THE DRAWINGS

DESCRIPTION OF A PREFERRED EMBODIMENT OF THE INVENTION

The following description assumes that the gun is in its operative position, supported by the marksman and abutted against his shoulder. With reference to this position, the terms "forwardly", "rearwardly", "above", "below" etc. are used to indicate relative positions and not in a limiting sense.

Figures 1, 2:
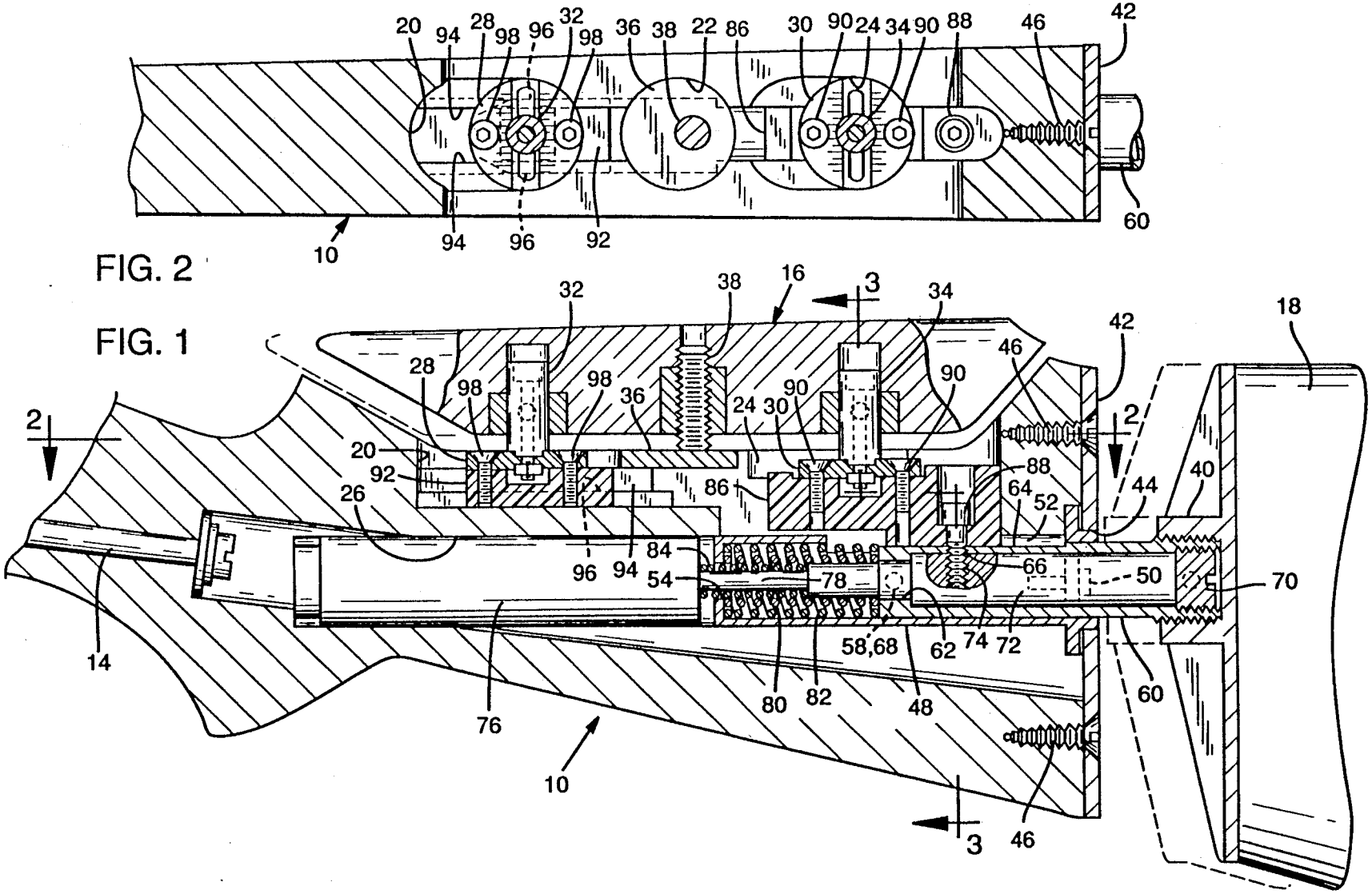
FIG. 1 is a fragmentary, longitudinal, vertical sectional view of the shoulder gun stock assembly of my invention.
FIG. 2 is a fragmentary sectional view taken along line 2—2 of FIG. 1.
Figure 3:
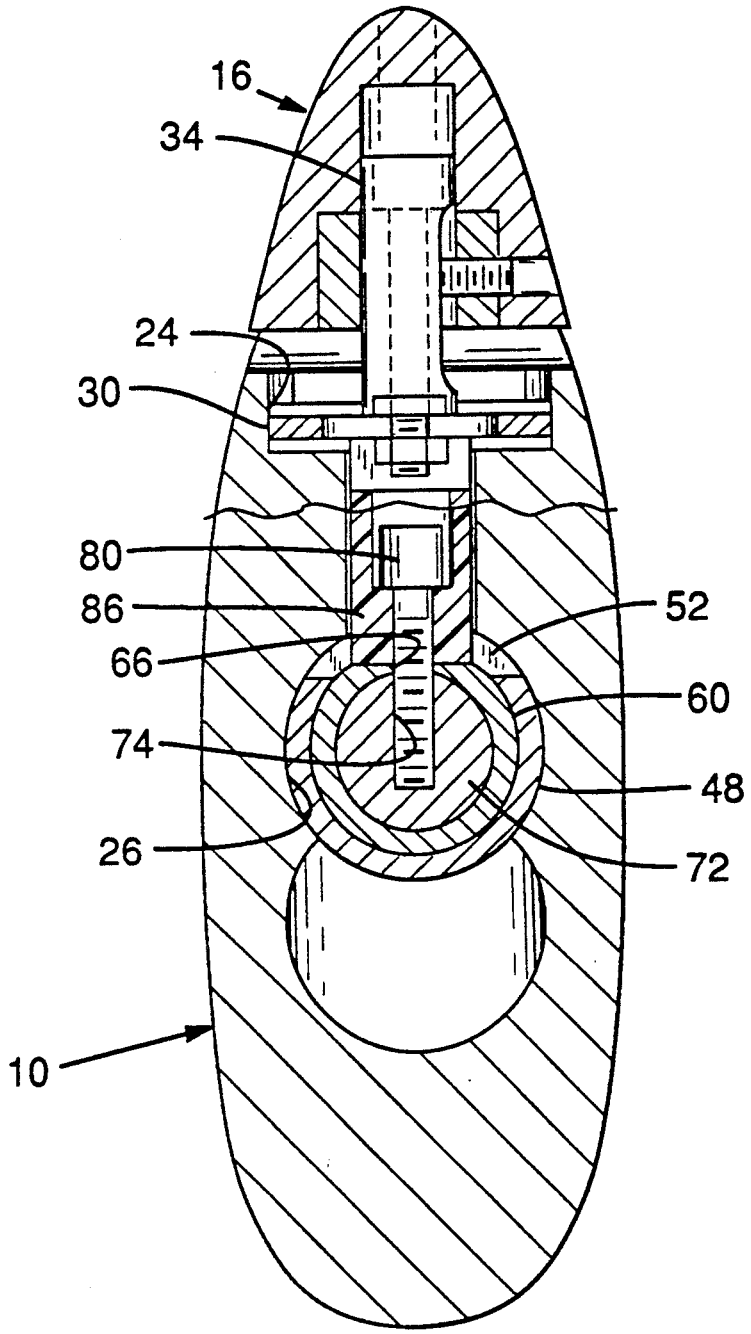
FIG. 3 is a transverse sectional view taken along line 3—3 of FIG. 1.

As is apparent from FIG. 1, the gun stock assembly of my invention basically comprises a stock base, indicated generally at 10, which may be secured to the trigger segment 12 of the gun by means of stock bolt 14 in conventional manner. A comb cheek rest 16 is mounted on the top of the stock base and a recoil absorbing shoulder piece 18 on its rearward end.

It is a feature of the invention that the comb cheek rest may be created by cutting away the upper portion of the stock to form a cavity in the remaining truncated stock base in which the comb nests for longitudinal movement during shooting of the gun, as indicated by the dashed outline of FIG. 1.

Figure 4:
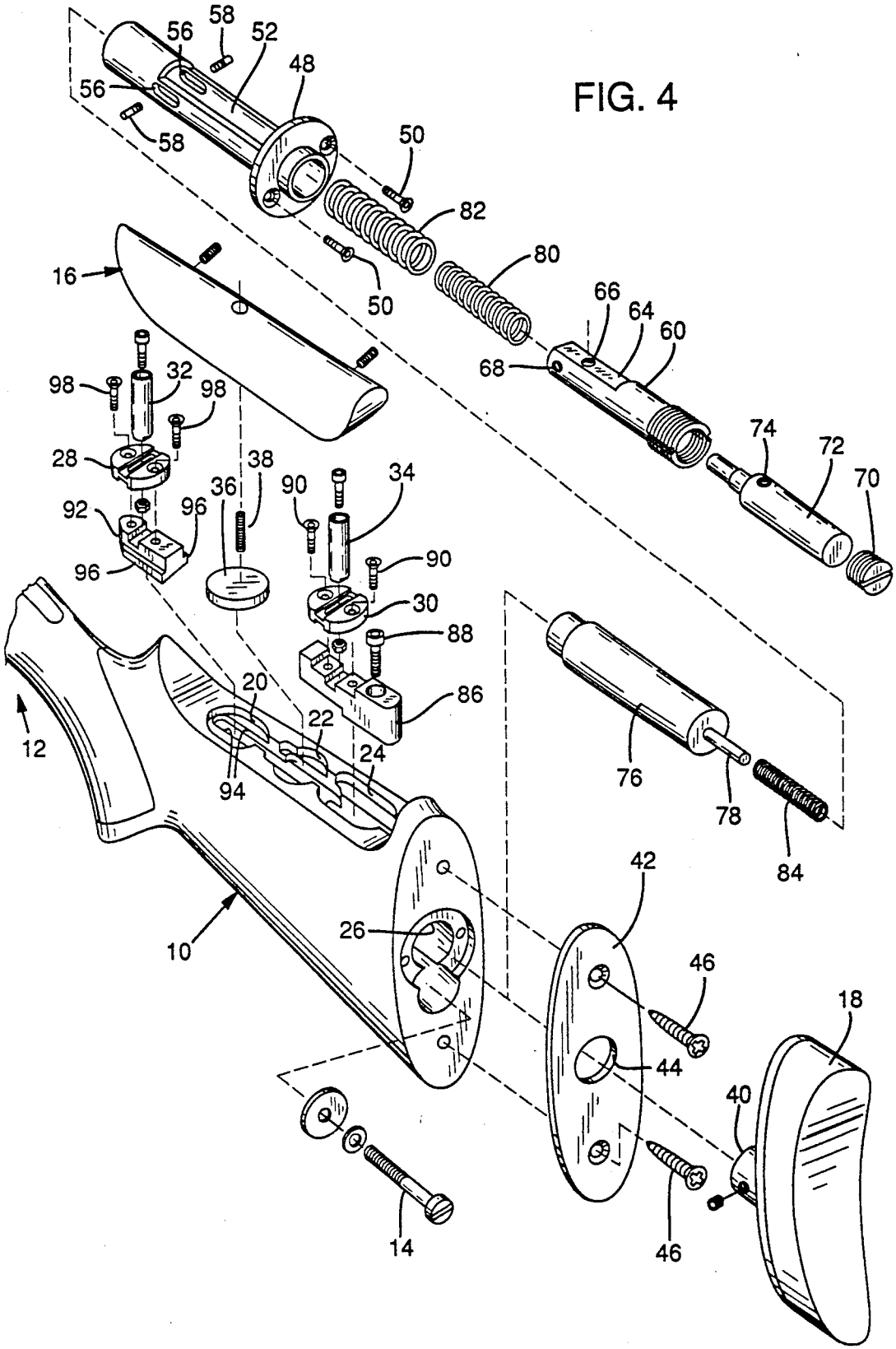
FIG. 4 is a fragmentary, exploded, top perspective view showing the components of the gun stock assembly in the order of their arrangement within the stock.

As shown particularly in FIG. 4, the residual stock base is milled out to provide a longitudinally extending recess having a forward segment 20, a central segment 22 and a rearward segment 24.

Stock base 10 also is provided with a longitudinal bore 26 located below and generally parallel to the recess segments described above. The rearward portion of the bore, i.e. that adjacent shoulder piece 18, communicates with rearward recess segment 24 for a purpose which will appear hereinafter.

Mounting means of known construction are provided for mounting comb piece 16 to stock base 10. To this end there are provided conventional forward and rearward contoured, calibrated mounting plates 28, 30.

Forward and rearward mounting post assemblies, also of conventional construction and indicated at 32, 34 of FIG. 1 are releasably bolted for lateral adjustment to the respective mounting plates.

The comb piece slides vertically on these posts. Its vertical adjustment is secured in known manner by the provision of a bearing plate 36 in central recess 22. This cooperates with a jack screw assembly 38 with associated set screw, not shown.

Shoulder piece 18 is provided with an outwardly extending, inwardly threaded socket 40 by means of which it is releasably attached to a recoil-absorbing mechanism housed in recesses 20, 22, 24 and in longitudinal bore 26. The construction of this mechanism is as follows:

A butt plate 42 having a central opening 44 registering with the outer end of longitudinal bore 26 is fastened to the butt end of the stock base by means of screws 46.

A flanged tubular casing 48 having an open end registering with opening 44 in the butt plate is seated in the rearward end of bore 26.

As shown particularly in FIG. 4, the flange of the casing is perforated to provide openings for support screws 50. The upper end of the casing is slotted longitudinally at 52, FIG. 4. Its inner end wall is provided with a central opening 54. Its side wall is perforated to provide access openings 56 for assembly screws 58.

Received in casing 48 is a thrust tube or hollow plunger 60. The construction of this element of the assembly also is shown in detail in FIG. 4.

Thrust tube 60 affords a means of attachment to shoulder piece 18. To this end it extends outwardly through the terminal openings in butt plate 42 and casing 48. Its outer or rearward end is threaded for threaded engagement with socket 40 on the shoulder piece. Its inner end is partially closed, with a central opening 62. Its upper surface is provided with a flat 64. Centrally of the flat is a threaded opening 66. On its inner end, at the sides, are threaded openings 68. These receive assembly screws 58 and hold the recoil assembly together when it is mounted in the gun stock base.

Thrust tube 60 houses in its outer end the filler plug 70. It also receives a plunger or thrust rod 72, the construction of which also is shown in detail in FIG. 4.

Thrust rod 72 has an inner end which projects outwardly through opening 62 in thrust tube 60. It also has a tapped and threaded opening 74 in its upper surface opposite casing slot 52.

To absorb the recoil developed during shooting, a versatile and effective damping unit is associated with the thrusting plunger assembly thus described. Its construction is shown in FIGS. 1 and 4.

The damping assembly employed comprises a conventional hydraulic or air cylinder shock absorber 76 having a rearwardly extending actuating piston 78. The latter is substantially axially aligned with thrust rod 72 and abuts its inwardly directed shouldered extension.

The damping effect of cylinder 76 is augmented and controlled in variable degree by a plurality of associated coil springs. These are arranged coaxially. Two of them, i.e. springs 80, 82 are mounted on the inwardly directed shoulder extension of thrust rod 72. The third, i.e. spring 84, is mounted on piston 78 of cylinder 76.

By including in the assembly selected ones or all of the springs, the magnitude of the recoil absorbing effect may be varied as desired.

Connecting means are provided for connecting the recoil absorbing assembly with comb piece 16 so that the latter is tied to shoulder piece 18 with the result that both comb piece and shoulder piece remain stationary while the stock base moves with the recoil.

To this end there is mounted in rearward recess 24 a slide block indicated generally at 86.

Slide block 86 has a stepped undersurface which engages flat 64 on thrust tube 60. It mounts a substantial bolt 88 which releasably fixes the slide block both to thrust tube 60 and thrust rod 72.

Rearward mounting plate 30 is secured to the upper surface of the thrust block by means of bolts 90. As noted hereinabove, this mounting plate mounts one of the two mounting post assemblies, i.e. mounting post assembly 34, by means of which comb piece 16 is mounted on the gun stock base.

Forward slide block 92 is slidably mounted in tracks 94 in forward recess 20. The slide block is equipped with flanges 96 which operatively engage the tracks.

Forward slide block 92 is secured by means of bolts 98 to mounting plate 28 by means of which forward comb mounting post assembly 32 is fastened to the slide block.

OPERATION

In operation, the tension of the unit is adjusted by inclusion of the selected ones of recoil springs 80, 82, 84. The vertical position of comb piece 16 is adjusted by means of jack screw assembly 38. Its lateral position or "cast" is adjusted by means of comb piece mounting post assemblies 32, 34.

In shooting, shoulder piece 18 is held snugly to the shoulder. Upon firing, stock base 10 kicks rearwardly. However, the shoulder piece remains still. The comb piece also remains still, without chafing the cheek of the marksman, since it is tied to the stationary shoulder piece by means of thrust mounting post assembly 34. Forward slide block 92 and associated mounting post assembly 32 guide and stabilize the comb piece during its movement.

Having thus described in detail a preferred embodiment of the invention, it will be apparent to those skilled in the art that various physical changes may be made in the invention described without altering the inventive concepts and principles embodied. The present embodiment is therefore to be considered as illustrative and not restrictive, the scope of the invention being indicated by the appended claims.

I claim:

1. A shoulder gun stock assembly comprising:

a) a base portion, b) a comb piece dimensioned and contoured to mount movably longitudinally on the base portion, c) a bore extending longitudinally centrally of the base portion, d) above the longitudinally extending bore a longitudinally extending recess communicating with the exterior, e) the recess having forward and rearward segments, f) the rearward segment of the recess communicating with the bore, g) a shoulder piece, h) recoil-damping plunger means mounted inside the bore and having an end extending rearwardly of the base, i) plunger connecting means connecting the plunger means to the shoulder piece, j) a first slide block, k) first mounting means mounting the first slide block slidably longitudinally in the rearward segment of the recess, l) first slide block connecting means connecting the same to the plunger means, m) a second slide block, n) second slide block mounting means mounting the second slide block slidably longitudinally in the forward segment of the recess, o) first comb piece support means mounting the comb piece to the first slide block, and p) second comb piece support means mounting the comb piece to the second slide block.

2. The shoulder gun stock assembly of claim 1 comprising a truncated base portion and a comb piece dimensioned and contoured to nest movably and longitudinally within the truncated portion of the base portion.

3. The shoulder gun stock assembly of claim 1 wherein the second slide block mounting means comprise track and flange mounting means.

4. The shoulder gun stock assembly of claim 1 wherein the first and second comb piece support means comprise adjustable post support means.

5. The shoulder gun stock assembly of claim 1 wherein the recoil-damping plunger means comprise fluid-actuated cylinder damping plunger means.

6. The shoulder gun stock assembly of claim 1 wherein the recoil damping plunger means comprises spring-biased damping plunger means.

7. The shoulder gun stock assembly of claim 1 wherein the recoil damping plunger means comprise a combination of fluid-actuated-cylinder and spring-biased damping plunger means.

8. The shoulder gun stock assembly of claim 1 wherein the recoil damping plunger means comprises spring-biased damping plunger means including a plurality of coaxial coil springs selectively removable to adjust the damping pressure.

9. The shoulder gun stock assembly of claim 1 wherein the recoil damping plunger means comprises a thrust tube connected to the shoulder piece, a thrust plunger housed in the thrust tube, hydraulic cylinder damping means and associated multiple coil spring damping means biased against the thrust tube and thrust cylinder, and connecting means connecting the thrust tube and thrust cylinder to the second slide block.

* * * * *